US006345956B1

(12) United States Patent
Lin

(10) Patent No.: US 6,345,956 B1
(45) Date of Patent: Feb. 12, 2002

(54) IMPELLER OF A BLOWER HAVING AIR-GUIDING RIBS WITH GEOMETRICAL CONFIGURATIONS

(75) Inventor: Kuo-cheng Lin, Taoyuan C (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 09/610,438

(22) Filed: Jul. 3, 2000

Related U.S. Application Data

(63) Continuation-in-part of application No. 09/114,480, filed on Jul. 14, 1998, now abandoned.

(51) Int. Cl.[7] ..... F04D 29/28

(52) U.S. Cl. ..... 416/178; 416/184; 416/187; 416/200 R; 416/203; 415/119

(58) Field of Search ..... 715/119; 416/178, 416/184, 187, 200 R, 203

(56) References Cited

U.S. PATENT DOCUMENTS

| | | | | |
|---|---|---|---|---|
| 1,345,951 A | | 7/1920 | Phelps | |
| 1,730,372 A | * | 10/1929 | Lawrie | 416/187 |
| 2,315,407 A | | 3/1943 | Evans | |
| 2,424,501 A | | 7/1947 | Place | |
| 2,431,648 A | | 11/1947 | Mayne | |
| 2,628,419 A | | 2/1953 | Wilken | |
| 3,211,364 A | | 10/1965 | Wentling et al. | |
| 4,470,753 A | | 9/1984 | Witzel | |
| 4,639,193 A | | 1/1987 | Reichert et al. | |
| 5,746,577 A | | 5/1998 | Ito et al. | |

FOREIGN PATENT DOCUMENTS

| | | | | |
|---|---|---|---|---|
| CA | 459563 | | 9/1949 | |
| CA | 610132 | | 12/1960 | |
| DE | 576998 | | 5/1933 | |
| FR | 1376180 | | 9/1964 | |
| FR | 2020367 | | 7/1970 | |
| GB | 469970 | | 8/1937 | |
| JP | 52-41907 | | 3/1977 | |
| JP | 53-126510 | | 11/1978 | |
| JP | 57-153996 A | * | 9/1982 | 416/178 |
| JP | 58-122396 | | 7/1983 | |
| JP | 60-166789 | | 8/1985 | |
| JP | 61-169694 | | 7/1986 | |
| JP | 5-195996 | | 8/1993 | |
| SU | 383895 | | 10/1973 | |

* cited by examiner

*Primary Examiner*—Christopher Verdier
(74) *Attorney, Agent, or Firm*—Bacon & Thomas, PLLC

(57) ABSTRACT

An air-guiding impeller for a blower. The impeller includes a rotary shaft adaptable for a motor, an annular frame, blades formed on the annular frame, and air-guiding ribs interconnected between the annular frame and the rotary shaft and inclined with respect to the annular frame.

12 Claims, 11 Drawing Sheets

IMPELLER OF A BLOWER HAVING AIR-GUIDING RIBS WITH GEOMETRICAL CONFIGURATIONS

CONTINUATION IN PART APPLICATION DATA

The present application is a continuation-in-part of prior filed U.S. application Ser. No. 09/114,480, filed Jul. 14, 1998, now abandoned.

BACKGROUND OF THE INVENTION

1. Field of the Invention

The invention relates to an impeller of a blower, and more particularly, to an air-guiding impeller of a centrifugal blower having air-guiding ribs with a geometrical configuration for modulating the distribution of airflow.

2. Description of the Related Art

A centrifugal blower has a generally cylindrical impeller which is driven by a motor and the like disposed at the center thereof and which rotates in one direction so as to pull air in along its central axis as it rotates, and then forces the air radially outwardly, turning the air ninety degrees in effect. According to their air-intake path, the centrifugal blowers can further be divided into two categories: the single-suction blowers and the dual-suction blowers. A single-suction blower pulls air from only one side of the blower, while the dual-suction blower draws air in from both sides of the blower. Such centrifugal blowers are widely used in computers, copiers, printers, etc., to circulate the internal air for cooling.

A conventional centrifugal blower makes a lot of noise while performing the air circulation. For instance, a runner of a sirocco type fan has been disclosed in the Japanese Patent No. 126510 (hereinafter referred to as '510 reference), as shown in FIGS. 1A and 1B. A main plate 2 made of a thick iron plate, which is fixed to a boss 3 of a rotary shaft 1 of the driving motor of the blower, transmits a rotary torque to the impeller comprising a plurality of blades 4. Each blade 4 is fixed at one end to one side of the main plate 2 at the outer periphery of the plate 2, and fixed at the other end to a side plate 5. The main plate 2 has several holes 6 to reduce the difference in the rigidity (or the distortion) of plates 2 and 5, and, in turn, reduce the stress produced in each blade 4. Since two ends of each blade 4 are fixed to plates 2 and 5 respectively, so the blade 4 can be placed in a severe environment, for example, the blades can sustain a high temperature blast. This is the primary object of '510 reference. A thin sheet 7 is further fastened onto the other side of the main plate 2 so as to seal the holes 6 for blocking the air passage. FIG. 1C is a diagram showing the airflow path, illustrated by dotted lines, of a blower using the prior impeller structure shown in FIG. 1A. As the length of the blade 4 increases, the strength of the whole impeller decreases. So, it makes the fabricating processes more difficult. Moreover, in most cases, the intake air leaves the impeller before it can reach the lower end of blades 4, resulting in an empty area D in the airflow path and thus deteriorating the performance of impeller.

The '510 reference also shows a second prior art shown in FIGS. 2A and 2B, wherein the rotary torque is transmitted to the impeller through a main plate 2 as in the above-described prior art. The main plate 2 is a thicker iron plate without any hole on it. An annular side plate 5 made of a thin iron plate is connected to the boss 3 of the rotary shaft 1 through several radial ribs 9 so as to reduce rigidity difference between plates 2 and 5, and stress produced in each blade 4. Each radial rib 9 is of a plane shape and is provided merely for connecting the plate 5 to the boss 3 and is integrally formed on the same plane with respect to the plate 5. However, the plane-shaped rib 9 is likely to disturb the inlet airflow of the blower, and thus deteriorate the fluid kinetics of the impeller.

Another embodiment of the '510 reference is shown in FIG. 3. This embodiment is similar to the above-described embodiments except that two intermediate annular plates 12 and 13 are interposed between the main plate 2 and the side plate 5. Each of the intermediate annular plate 12 and 13 is provided with several holes, each of which fastens one of the blades 4 and prevents an intermediate portion of each blade 4 from becoming distorted. Each of the intermediate annular plate 12 and 13 is connected to the boss 3 of the rotary shaft 1 through several radial ribs 14. The radial ribs 14 are provided purely for connecting the intermediate annular plate 12 and 13 as described in the Japanese specification and are integrally formed on the same plane with respect to the intermediate annular plate 12 and 13.

Shown in FIG. 4 is another conventional impeller structure 31, which comprises a main plate 32 and a plurality of blades 34 integrally formed with the main plate 32 and evenly disposed along outer periphery on both sides of the main plate 32. Each upper blade 34 located on the top surface of main plate 32 aligns with a lower blade 34 in vertical direction. Therefore, these blades 34 of impeller 31 are "aligned" , and the impeller 31 is called a "collateral impeller" . Rotary torque from the rotary shaft 33 of the motor is transmitted to the blades 34 by the main plate 32. With this structure, the impeller 31 can be mounted into a dual-suction blower successfully. Compared to the blades 4 of FIG. 1A, the length of each blade 34 of FIG. 4 is only half of that of the blade 4, thereby increasing the strength of every blade and making the fabrication of the impeller easier.

Another impeller 41 is provided to reduce the noise, as shown in FIG. 5. It is known that the noise generated by a blower relates to the rotation speed and the dimension of its impeller. As the edge of blade passes through the tongue of the blower, it hums, which causes the noise. The impeller 41 is composed of a main plate 42, a plurality of upper blades 44 integrally formed with the main plate 42 and evenly disposed along the outer rim on the upper side of the main plate 42, and a plurality of lower blades 44' disposed in a similar manner on the lower side of the main plate 42. The upper blades 44 and the lower blades 44'are alternately disposed. Rotary torque from the motor 43 is transmitted to the blades 44 and 44' by the main plate 42. Comparing the impeller 41 with the impeller 31 shown in FIG. 4, the length of a blade edge passing through the tongue of the blower per unit time is reduced by half, while the frequency of the hum increases. As a result, the noise generated by the impeller 41 can be reduced effectively by carrying a lower amplitude.

FIGS. 6A–6C are diagrams showing the airflow path of an impeller having a structure as shown in FIGS. 4 or 5. Referring to FIG. 6A, the main plate 42 has no hole for airflow. The impeller 41 works well in a dual-suction blower when the air-intake path on both sides of blower is fluent. However, when a blower is mounted closely on a surface W, as shown in FIG. 6B, the airflow path from the lower side of the blower is blocked. As a result, the performance of the impeller deteriorates. In addition, when the impeller 41 is mounted onto a single-suction blower, as shown in FIG. 6C, the main plate 42 blocks the supply of airflow from the upper side. Thus, the intake airflow can only be applied to the upper blades. Thus, the impeller 41 becomes even less inefficient when mounted onto a single-suction blower.

SUMMARY OF THE INVENTION

It is an object of the invention to provide an impeller of a blower having air-guiding ribs with a geometrical configuration and formed on a different plane with respect to an annular frame, thereby modulating the distribution of airflow more evenly, reducing the noise generated during the operations of the blower, and increasing the air suction force and the intake airflow.

It is still an object of the invention to provide an impeller of a blower having air-guiding ribs with a geometrical configuration which is adaptable for either a dual-suction blower or a single-suction blower.

It is yet still another object of the invention to provide an impeller of a blower which can eliminate an empty area of the intake airflow formed within the impeller by providing air-guiding ribs with a geometrical configuration and formed on a different plane with respect to an annular frame.

Accordingly, the impeller of the invention includes a rotary shaft adaptable for a motor, an annular frame, a plurality of blades formed on the annular frame, and a plurality of air-guiding ribs each interconnected between the annular frame and the rotary shaft inclined with respect to the annular frame. Each of the air-guiding ribs is characterized by forming on a different plane with respect to an associated annular frame and having a geometrical configuration selected from the group consisting of an eye shaped profile, a tear drop shaped profile, a parallelogram profile, a triangular profile, a slide shaped profile, a wave shaped profile, a rod shaped profile and a rhombus profile. As the air-guiding impeller rotates, the air is first pulled inwardly from the outside of the blower and then forced radially outwardly by the blades. During the same time, the air-guiding ribs with a featured cross-sectional profile induce an increased partial intake airflow into the blower, thereby modulating the distribution of the airflow within the blower and increasing the suction force and the intake airflow. Moreover, the present invention can reduce the noise because the length of blade edge passing through the tongue of blower per unit time is reduced by half.

DESCRIPTION OF THE PREFERRED EMBODIMENTS

To solve the aforementioned problems, the invention provides an improved impeller which is characterized by forming on a different plane with respect to an associated annular frame and having air-guiding ribs with a geometrical configuration. The function of the air-guiding ribs is not for connecting to the rotary shaft and an associated tier of annular frame only, it also helps to increase air suction force during the passage of the airflow, thereby to modulate the distribution of said intake airflow within said blower.

Figure 1A:
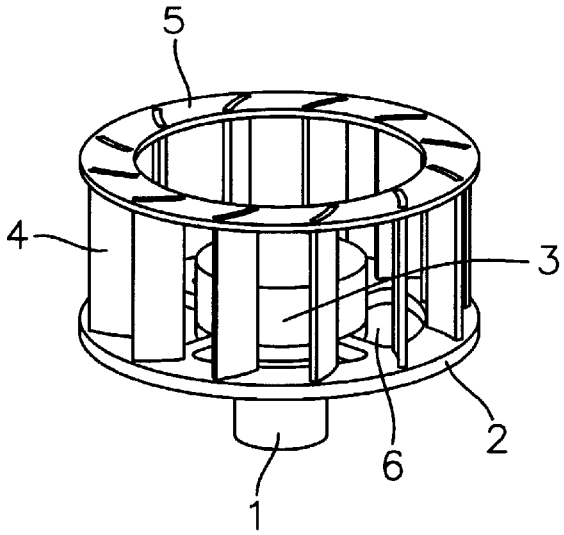
FIG. 1A (PRIOR ART)
FIG. 1A is a diagram showing a first prior impeller disclosed in the '510 reference.
Figure 1B:
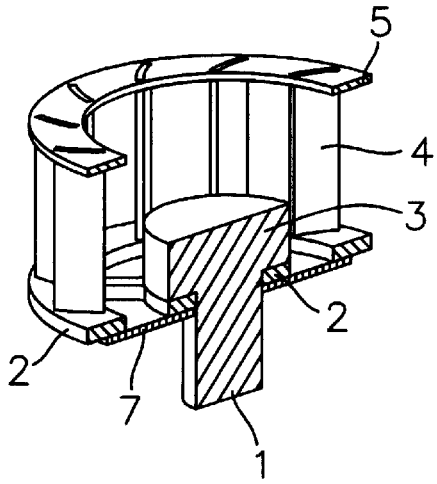
FIG. 1B (PRIOR ART)
FIG. 1B is a cutaway view of the impeller as shown in FIG. 1A.
Figure 1C:
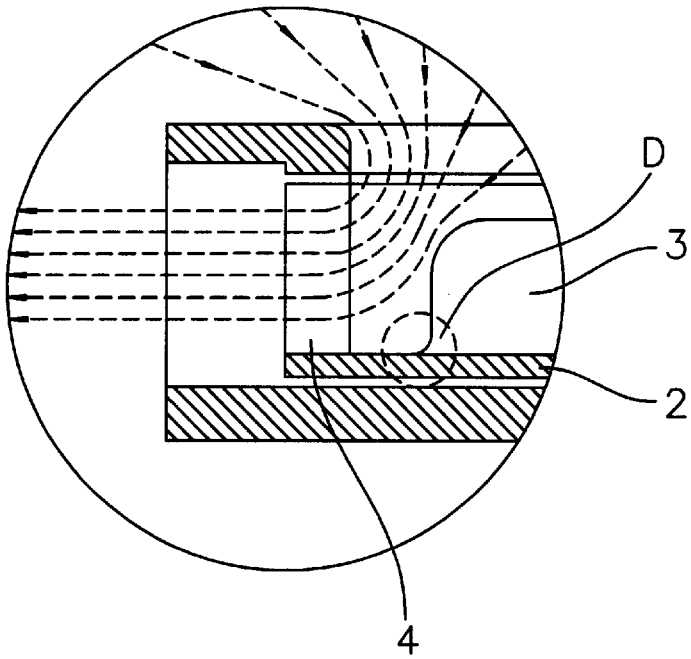
FIG. 1C (PRIOR ART)
FIG. 1C is a diagram showing the airflow path of a blower using the prior impeller structure as shown in FIG. 1A.
Figure 2A:
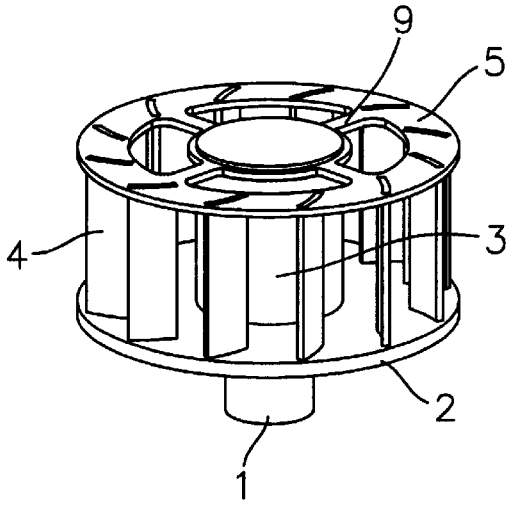
FIG. 2A (PRIOR ART)
FIG. 2A is a diagram showing a second embodiment as disclosed in the '510 reference.
Figure 2B:
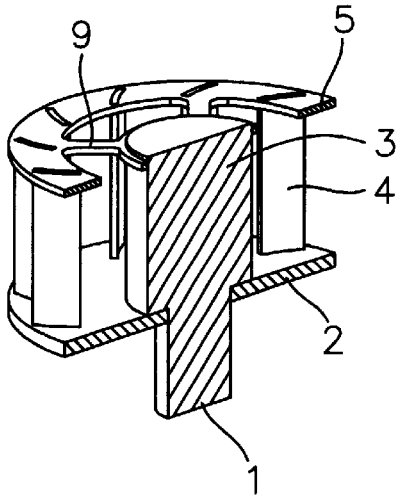
FIG. 2B (PRIOR ART)
FIG. 2B is a cutaway view of the second embodiment as shown in FIG. 2A.
Figure 3:
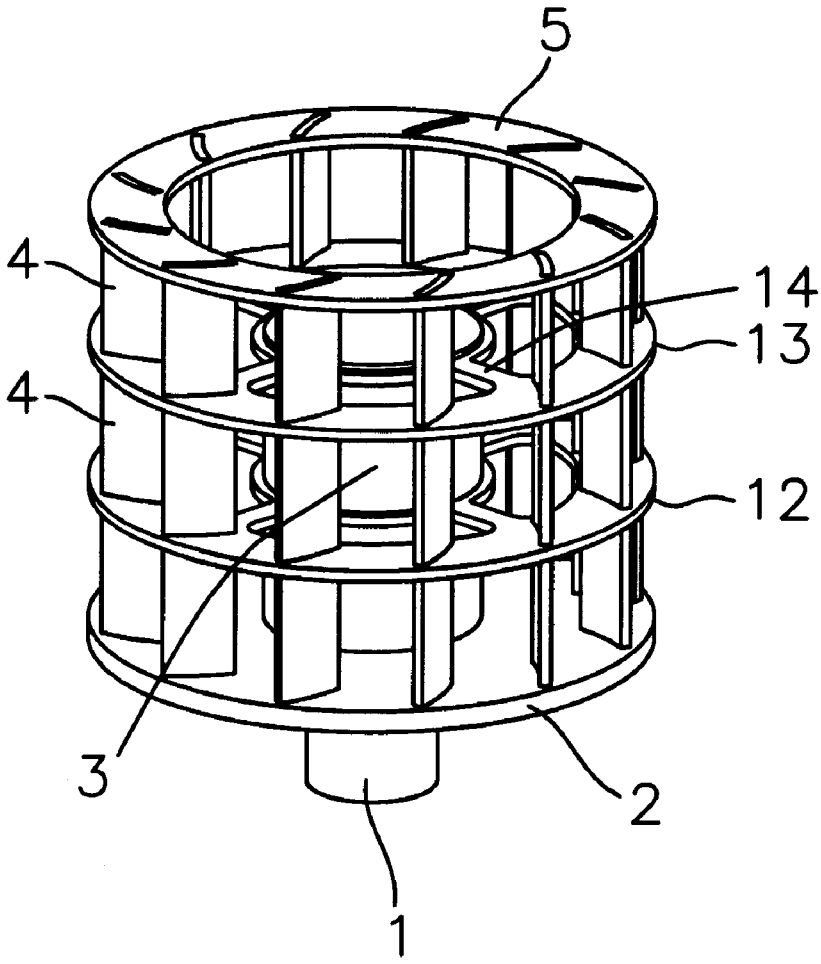
FIG. 3 (PRIOR ART)
FIG. 3 is a diagram showing a third embodiment as disclosed in the '510 reference.
Figure 4:
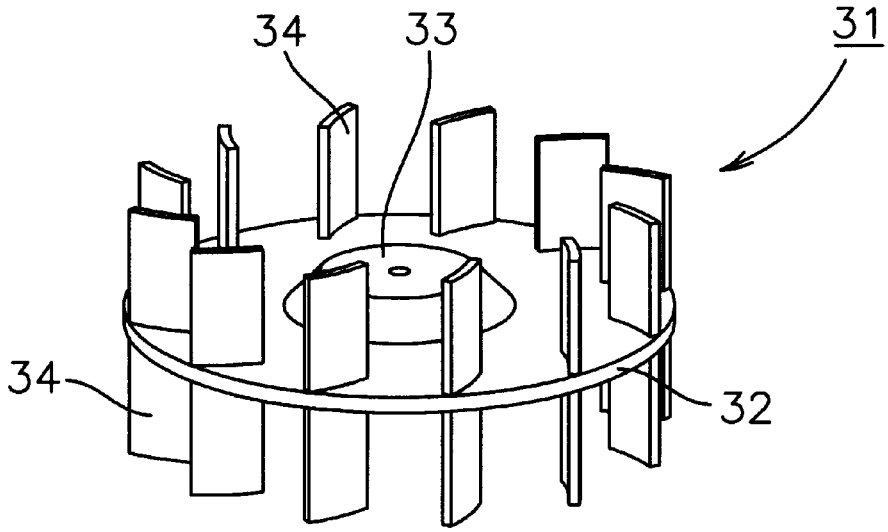
FIG. 4 (PRIOR ART)
FIG. 4 is a schematic view of a conventional collateral impeller.
Figure 5:
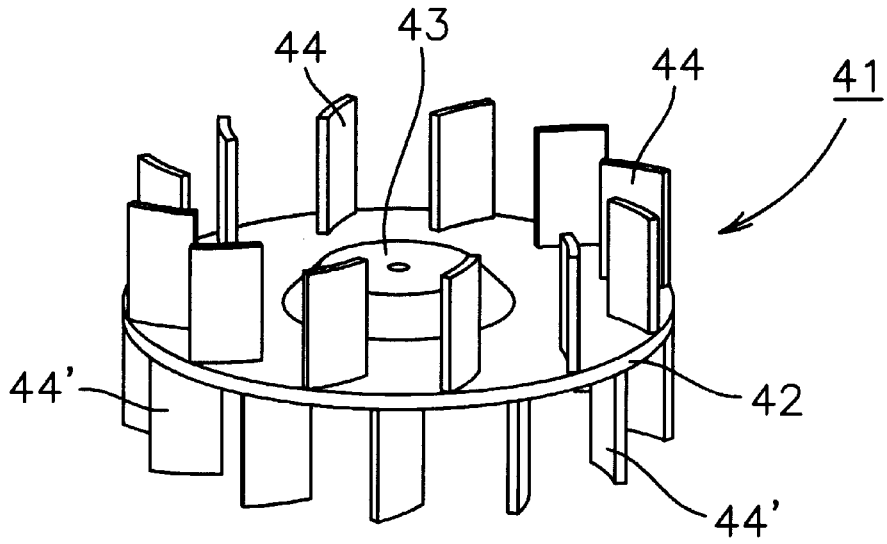
FIG. 5 (PRIOR ART)
FIG. 5 is a schematic view of a conventional impeller.
Figure 6A:
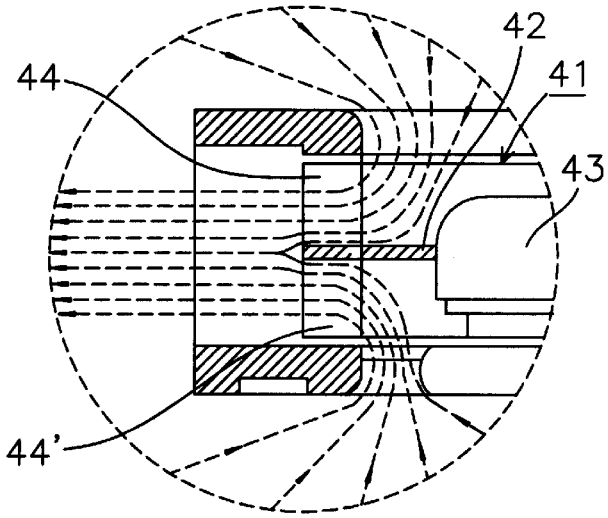
FIG. 6A (PRIOR ART)
FIGS. 6A~6C are diagrams showing the airflow path within a blower having a structure as shown in FIGS. 4 or 5.
Figure 6B:
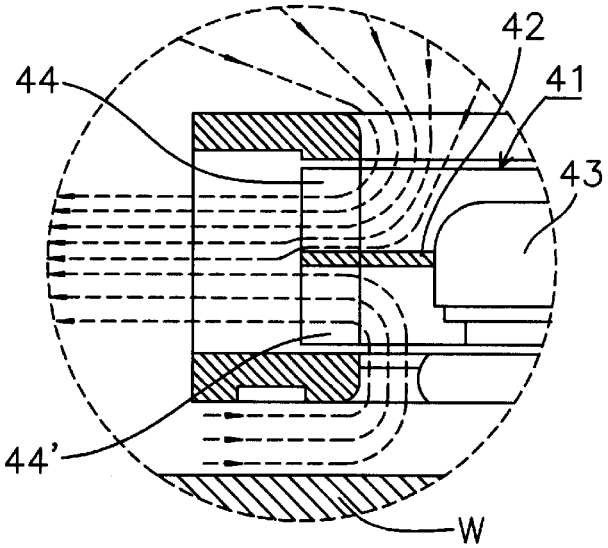
FIG. 6B (PRIOR ART)
Figure 6C:
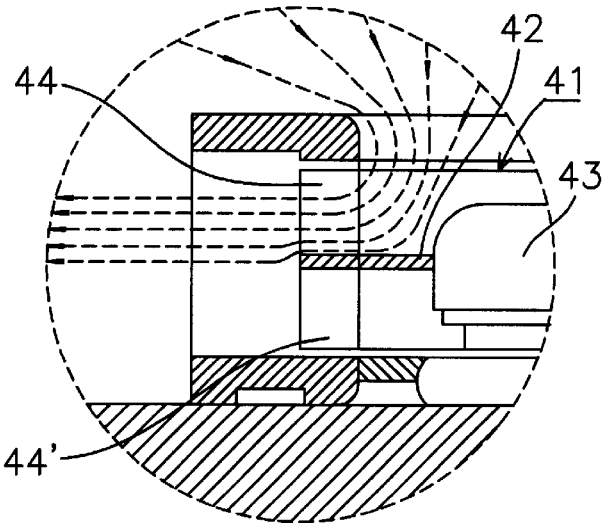
FIG. 6C (PRIOR ART)
Figure 7A:
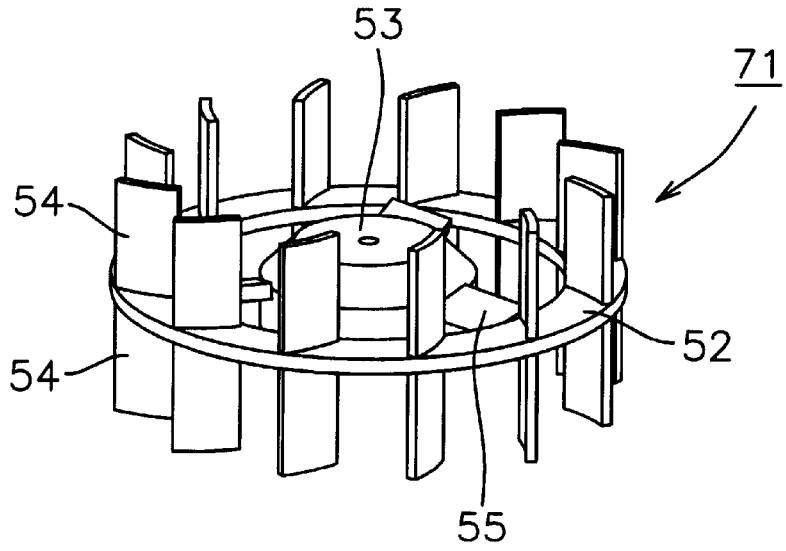
FIG. 7A shows the structure of an air-guiding impeller according to the first preferred embodiment of the present invention.

Refer to FIG. 7A, an air-guiding impeller 71 is mounted onto a blower having a motor (not shown), and is adapted to rotate when being driven by the motor so as to drive airflow in a specific direction. This air-guiding impeller 71 includes an annular frame 52, a plurality of blades 54 evenly disposed on upper and lower surfaces of the annular frame 52, and a plurality of air-guiding ribs 55 interconnected between the annular frame 52 and the rotary shaft 53 of the motor for transmitting a rotary torque from the rotary shaft 53 of the motor to the annular frame 52.

Figure 7B:
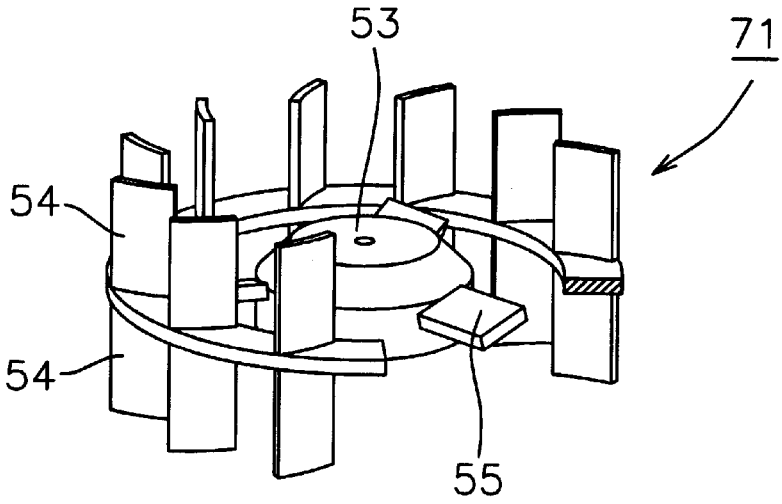
FIG. 7B is a partially cutaway view of the air-guiding impeller as shown in FIG. 7A.

The air-guiding ribs 55 are geometrically configured and formed on a different plane (or inclined) with respect to the annular frame 52 as illustrated in FIG. 7B. The inclination of the air-guiding ribs 55 helps to obtain an air pressure increment (air suction force) during the passage of the airflow and induces part of the intake air into the blower to modulate the distribution of airflow within the blower.

Figure 8A:
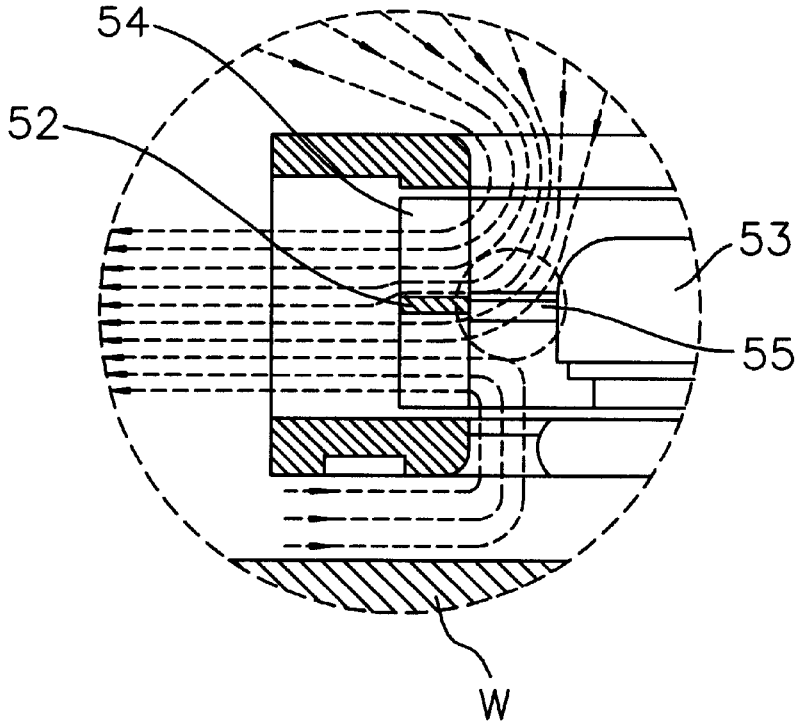
FIGS. 8A and 8B are diagrams showing the airflow path within a blower as shown in FIG. 7A.
Figure 8B:
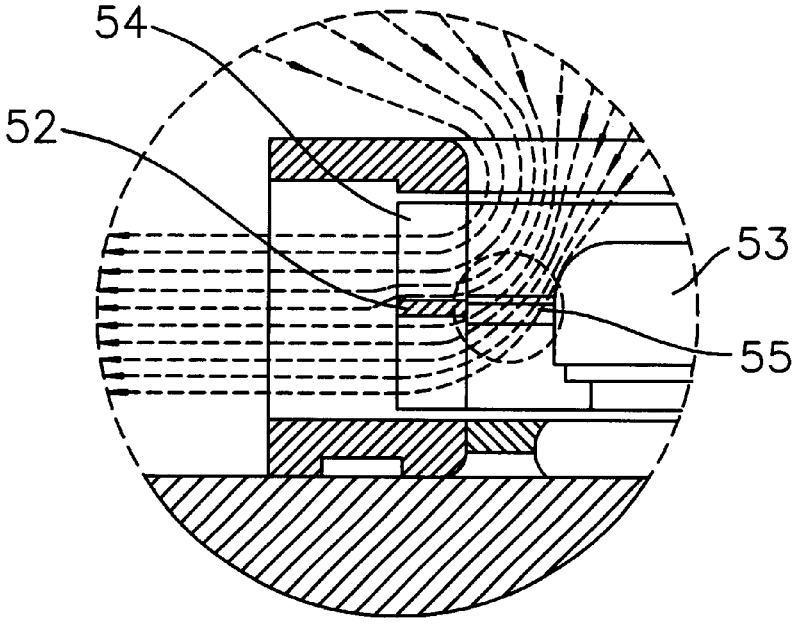

The functions of the geometrically configured air-guiding ribs 55 can be illustrated more clearly from FIGS. 8A and 8B. Refer to FIG. 8A, when the air-guiding impeller 71 of the invention is applied to a dual-suction blower, the air-intake volume on both sides of blower can be enhanced. As the air-guiding impeller rotates, the air is first pulled inwardly from top and bottom atmosphere of the blower and forced radially outwardly by the blades 54. The air-guiding ribs 55 with an advantageous inclination increase the volume of the intake air into the blower and thus enhances the airflow applied onto the blades 54. As a result, an empty area will not be formed near the lower portion of the rotary shaft 53. Moreover, the distribution of airflow can also be modulated more efficiently within the blower by such geometrical configuration on the air-guiding ribs. Eventually, the suction force and the intake airflow of the air-guiding impeller can both be increased.

On the other hand, when the air-guiding impeller of the invention is applied to a blower mounted closely on a surface W, as shown in FIG. 8B, the lower side of the blower is blocked. By geometrically configuring the air-guiding ribs 55 and forming the air-guiding ribs 55 on a different plane with respect to the annular frame 52, the performance of the blower ran be improved even the lower side of the blower is blocked. The air-guiding ribs 55 with an advantageous inclination induce an increased volume of the intake air from the top side into the blower to enhance the airflow applied onto the blades 54. Eventually, the suction force and the intake airflow of the air-guiding impeller can also be increased without forming an empty area.

Figure 10A:
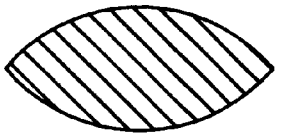
FIGS. 10A~10H show several possible cross-sectional profiles for the geometrical configuration of the air-guiding ribs adaptable for the impeller of the present invention.
Figure 10B:
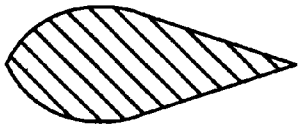
Figure 10C:
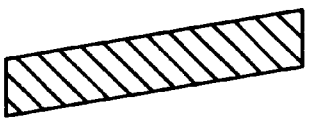
Figure 10D:
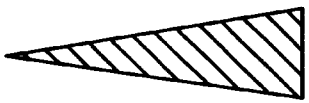
Figure 10F:
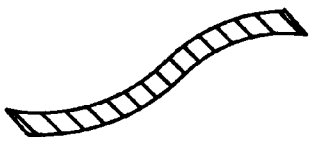
Figure 10H:
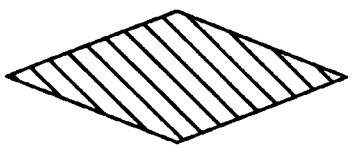
Figure 10E:
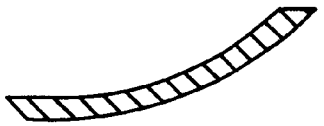
Figure 10G:
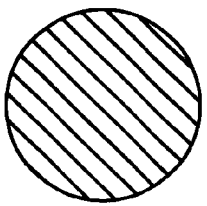

There are several possible geometrical configurations for the shapes of the air-guiding ribs as illustrated in FIGS. 10A~H. These geometrical configurations for the guiding ribs all can obtain an air pressure increment during the passage of the airflow when formed on a different plane with respect to an associated annular frame. For example, FIG. 10A shows an eye-shaped cross-sectional profile for the air-guiding ribs. FIG. 10B shows a tear-drop-shaped cross-sectional profile for the air-guiding ribs. FIG. 10C shows a parallelogram cross-sectional profile for the air-guiding ribs. FIG. 10D shows a triangular cross-sectional profile for the air-guiding ribs. FIG. 10E shows a slide-shaped cross-sectional profile for the air-guiding ribs. FIG. 10F shows a wave-shaped cross-sectional profile for the air-guiding ribs. FIG. 10G shows a rod-shaped cross-sectional profile for the air-guiding ribs. And FIG. 10H shows a rhombus cross-sectional profile for the air-guiding ribs. The selection of this geometrical configuration depends on practical application.

Figure 9:
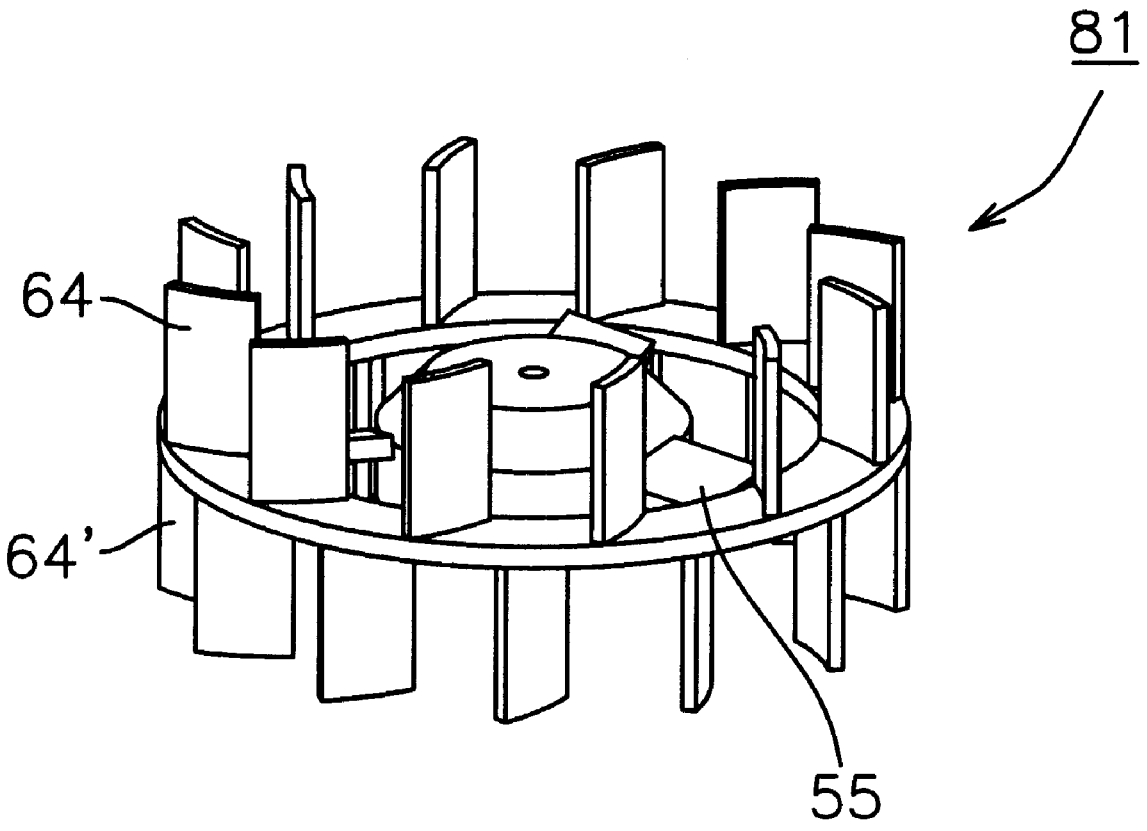
FIG. 9 shows the structure of an air-guiding impeller according to a second preferred embodiment of the present invention.

To reduce the noise occurred when the blower is operated, the upper blades 64 and the lower blades 64' are disposed alternately with respect to each other as illustrated in FIG. 9. The upper blades 64 are not aligned with the lower blades 64' in vertical direction or in the longitudinal direction of the blades 64 or 64'. Since the length of blade edge passing through the tongue of blower per unit time is reduced by half, the noise generated by the impeller 81 will carry a lower amplitude as compared to the impeller 71.

Figure 11:
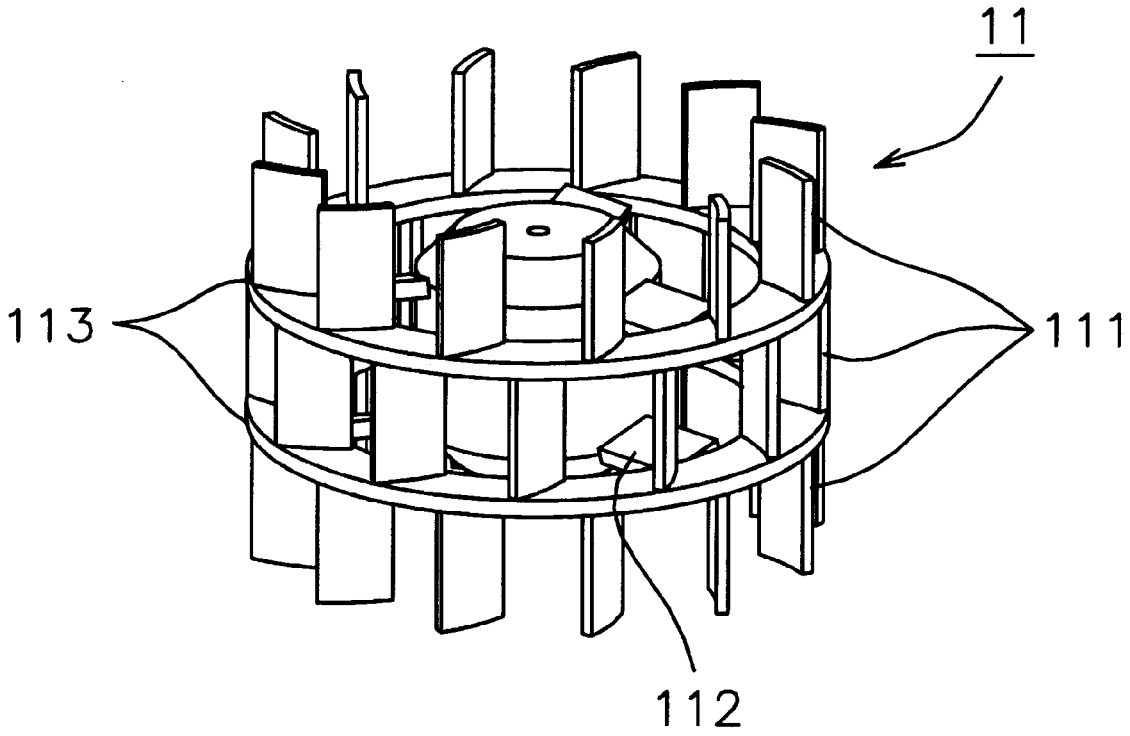
FIG. 11 shows the structure of an air-guiding impeller according to a third preferred embodiment of the present invention.

The structure of the air-guiding impeller can be modified as illustrated in FIG. 11. This air-guiding impeller 1 1 has two annular frames 113 each with a plurality of blades 111. To reduce the noise, the blades 111 on the annular frames 113 are disposed alternately with respect to each other. Air-guiding ribs 112 are also geometrically configured and inclined, with respect to the annular frames 113 to increase the air suction force and the intake airflow.

The impeller of the invention can be adaptable for either a dual-suction blower or a single-suction blower. With the air-guiding ribs of a geometrical configuration and formed on a different plane with respect to an associated annular frame, the empty area of the intake airflow within the blower can also be eliminated, thereby modulating the distribution of airflow within the blower more efficiently.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. An air-guiding impeller for a blower comprising:

a rotary shaft adaptable for a motor;

an annular frame;

a plurality of blades formed on said annular frame; and a plurality of air-guiding ribs interconnected between said annular frame and said rotary shaft and inclined with respect to said annular frame.

2. The air-guiding impeller as claimed in claim 1, wherein said plurality of blades are formed on upper and lower surfaces of said annular frame respectively and are arranged alternately.

3. The air-guiding impeller as claimed in claim 1, wherein said plurality of blades are formed on upper and lower surfaces of said annular frame respectively and are aligned with one another.

4. The air-guiding impeller as claimed in claim 1, wherein said plurality of air-guiding ribs have a geometrical configuration selected from the group consisting of an eye-shaped cross-sectional profile, a tear-drop-shaped cross-sectional profile, a parallelogram cross-sectional profile, a triangular cross-sectional profile, a slide-shaped cross-sectional profile, a wave-shaped cross-sectional profile, a rod-shaped-cross-sectional profile and a rhombus cross-sectional profile.

5. An air-guiding impeller for a blower having a rotary shaft adaptable for a motor, an annular frame, a plurality of blades disposed on said annular frame, characterized by having a plurality of air-guiding ribs interconnected between the annular frame and said rotary shaft and inclined with respect to said annular frame.

6. The air-guiding impeller as claimed in claim 5, wherein said plurality of blades are formed on upper and lower surfaces of said annular frame respectively and are arranged alternately.

7. The air-guiding impeller as claimed in claim 5, wherein said plurality of blades are formed on upper and lower surfaces of said annular frame respectively and are aligned with one another.

8. The air-guiding impeller as claimed in claim 5, wherein said plurality of air-guiding ribs have a geometrical configuration selectable from the group consisting of an eye-shaped cross-sectional profile, a tear-drop-shaped cross-sectional profile, a parallelogram cross-sectional profile, a triangular cross-sectional profile, a slide-shaped cross-sectional profile, a wave-shaped cross-sectional profile, a rod-shaped cross-sectional profile and a rhombus cross-sectional profile.

9. An air-guiding impeller for a blower comprising:

an annular frame having a central opening therethrough, the annular frame comprising upper and lower planar surfaces;

a rotary shaft adaptable for a motor, the rotary shaft inserted through the central opening of the annular frame;

a plurality of blades formed on at least one of the planar surfaces of the annular frame; and a plurality of air-guiding ribs each comprising upper and lower surfaces, each of the air-guiding ribs interconnecting the rotary shaft to the annular frame, the air-guiding ribs extending radially from the rotary shaft to form openings therebetween, and the surfaces of the air guiding ribs inclined with respect to the planar surfaces of the annular frame.

10. The air-guiding impeller as claimed in claim 9, wherein the plurality of blades are formed on both the upper and lower planar surfaces of the annular frame and are arranged alternately.

11. The air-guiding impeller as claimed in claim 9, wherein the plurality of blades are formed on both the upper and lower planar surfaces of the annular frame and are aligned with one another.

12. The air-guiding impeller as claimed in claim 9, wherein the plurality of air-guiding ribs have a geometrical configuration selected from the group consisting of an eye-shaped cross-sectional profile, a tear-drop-shaped cross-sectional profile, a parallelogram cross-sectional profile, a triangular cross-sectional profile, a slide-shaped cross-sectional profile, a wave-shaped cross-sectional profile, a rod-shaped-cross-sectional profile and a rhombus cross-sectional profile.

* * * * *